US007867101B2

(12) United States Patent
Chiang

(10) Patent No.: US 7,867,101 B2
(45) Date of Patent: Jan. 11, 2011

(54) FAMILY COMBINED BALL POOL STRUCTURE

(75) Inventor: San-Lang Chiang, Taipei Hsien (TW)

(73) Assignee: Li Hsen Plastics Co., Ltd., Shan Hsia Chen (TW)

( * ) Notice: Subject to any disclaimer, the term of this patent is extended or adjusted under 35 U.S.C. 154(b) by 209 days.

(21) Appl. No.: 12/344,071

(22) Filed: Dec. 24, 2008

(65) Prior Publication Data

US 2010/0159796 A1 Jun. 24, 2010

(51) Int. Cl.
*A63G 31/12* (2006.01)
*A63G 31/00* (2006.01)

(52) U.S. Cl. ..... 472/134; 446/476; 5/98.1

(58) Field of Classification Search ..... 472/134, 472/135, 136; 5/98.1, 99.1; 446/476, 478, 446/487; 135/126–129
See application file for complete search history.

(56) References Cited

U.S. PATENT DOCUMENTS 4,003,098 A * 1/1977 Fink ..... 5/93.1
4,815,153 A * 3/1989 Bleser et al. ..... 5/98.1
5,291,623 A * 3/1994 Artz ..... 5/93.1
5,462,505 A * 10/1995 Blair et al. ..... 482/27
5,678,357 A * 10/1997 Rubio et al. ..... 52/2.17
5,813,946 A * 9/1998 Lin et al. ..... 482/27
6,311,709 B1 * 11/2001 Louie et al. ..... 135/125
6,364,782 B1 * 4/2002 Ochi ..... 472/134
6,511,382 B1 * 1/2003 Ochi ..... 472/134
6,565,405 B2 * 5/2003 Hsu et al. ..... 446/89
6,752,163 B2 * 6/2004 Zheng ..... 135/126
6,799,338 B1 * 10/2004 Hsia ..... 5/93.1
7,108,608 B2 * 9/2006 Field et al. ..... 472/134
7,140,376 B2 * 11/2006 Zheng ..... 135/128
7,284,289 B1 * 10/2007 Biagini ..... 5/99.1

* cited by examiner

*Primary Examiner*—Kien T Nguyen
(74) *Attorney, Agent, or Firm*—Rabin & Berdo, P.C.

(57) ABSTRACT

A family combined ball pool structure is provided. The ball pool structure is formed by stacking a fence frame, an inflatable pad and an inflatable wall. The fence frame is an enclosed cloth screen frame having a bottom layer and a circumference side. The bottom and circumference side inside the fence frame are formed by the inflatable pad and the inflatable wall, respectively. Therefore, a child is placed in a safe space formed by the inflatable pad and the inflatable wall, which form a safe and fall-proof family ball pool with the enclosure of the fence frame.

4 Claims, 5 Drawing Sheets

FAMILY COMBINED BALL POOL STRUCTURE

BACKGROUND OF THE INVENTION

1. Field of Invention

The present invention relates to a family combined ball pool structure, and more particularly to an enclosed inflatable combined ball pool which is placed in a regular room for a child to play inside.

2. Related Art

Usually a child is always curious about things during the growth period. Since the balancing system for a child is not yet well developed, the child tends to fall down and bump into things. However, this period is a period when the sensory integration of a child grows fast. Therefore, toys that are most suitable for the growth of a child are those with a round shape, as well as meeting safety requirements. A "ball pool" is then a nice choice. However, most of the establishments having a ball pool are large-scale amusement establishments, and ball pools are usually not provided indoors.

To solve this problem, a common family selects an indoor "cloth frame structure" having a bottom and an enclosed circumference made of highly flexible thin steel wires and cloth. A quilt is laid on the bottom. Then a child and some toys and balls for the child to play with are put into the cloth frame structure. However, the structure enclosed by the steel wires and cloth is too soft and has a poor stability. When the child falls toward the circumference, the whole structure usually falls down or leans over. The structure fails to prevent the child from falling down, and the child might even fall out of the structure. Therefore, the safety of the cloth frame structure is not assured.

In addition, for a common family ball pool structure, balls are easily cast out of the ball pool. Also, the structure is a castle-like structure formed of inflatable plastic cloth for a child to play inside. The plastic cloth filled with air, however, is an enclosure formed by peripheral walls and a bottom pad. Thus, the space of the formed structure is complicated. It is difficult to inflate the structure, and the structures are bonded together with each other, and easily get broken when a great force is applied thereon.

SUMMARY OF THE INVENTION

The present invention is directed to a ball pool structure formed by stacking a fence frame, an inflatable pad and an inflatable wall. The ball pool structure is a combined structure, which is simple and may be manufactured separately. The combination of the structure is quite convenient, and a force for supporting the structure is appropriate. Thus, the present invention is a safe family ball pool structure.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In order to make the present invention more comprehensible, the present invention is described in the following with reference to the accompanying drawings.

Figure 1:
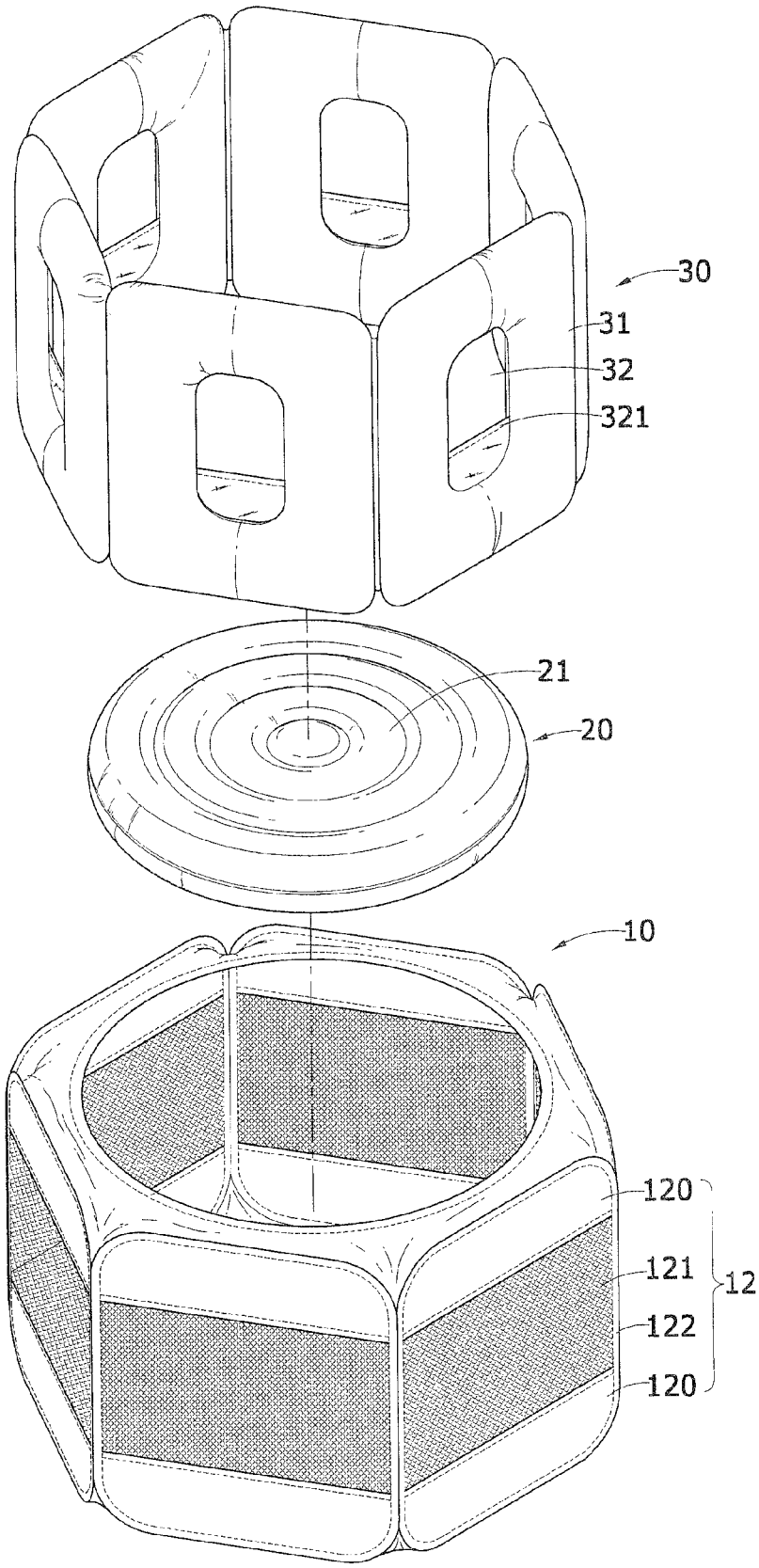
FIG. 1 is an exploded view of the structure according to the present invention.
Figure 2:
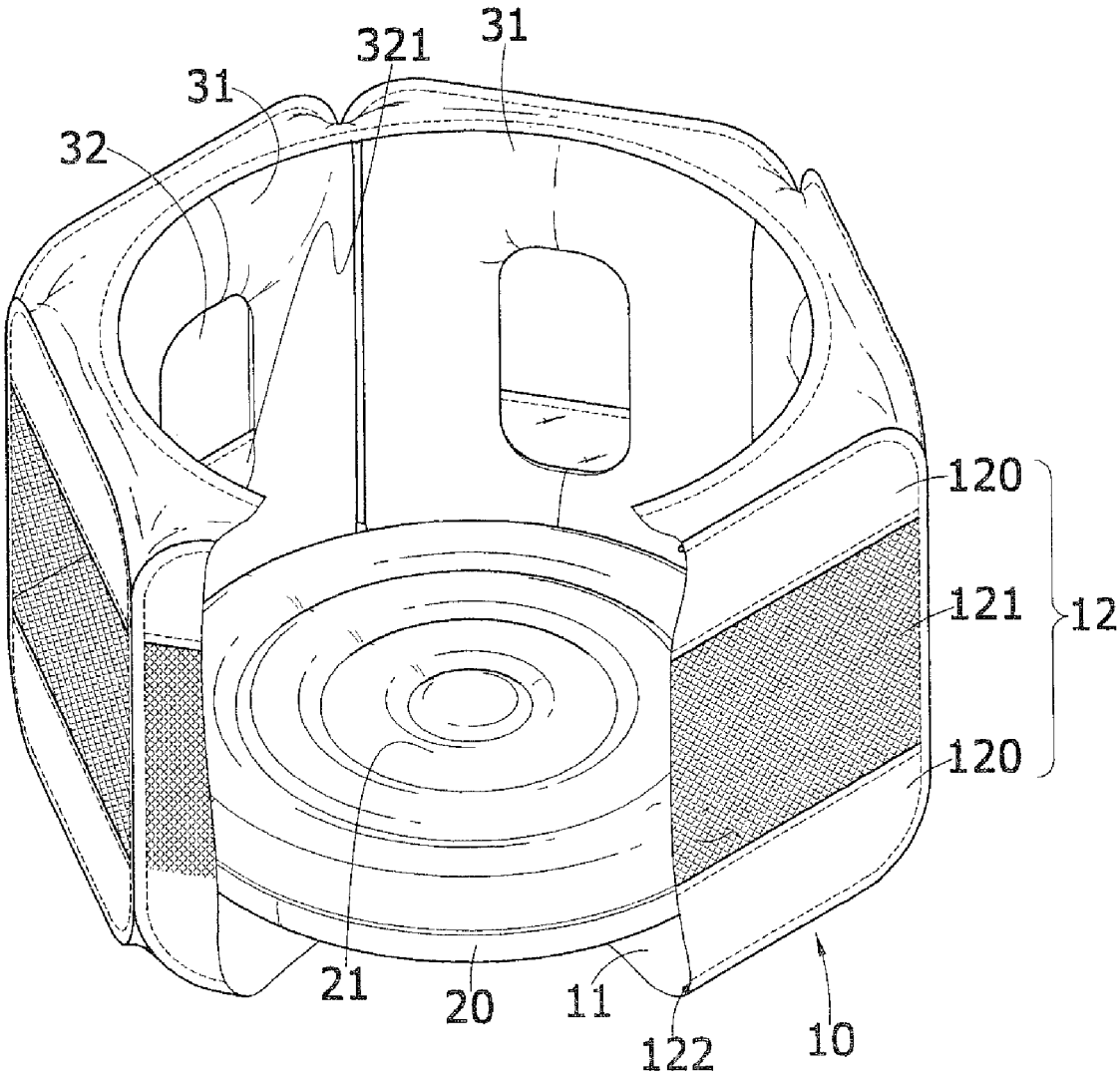
FIG. 2 is a partial cross-sectional view of the combined structure of the present invention.
Figure 3:
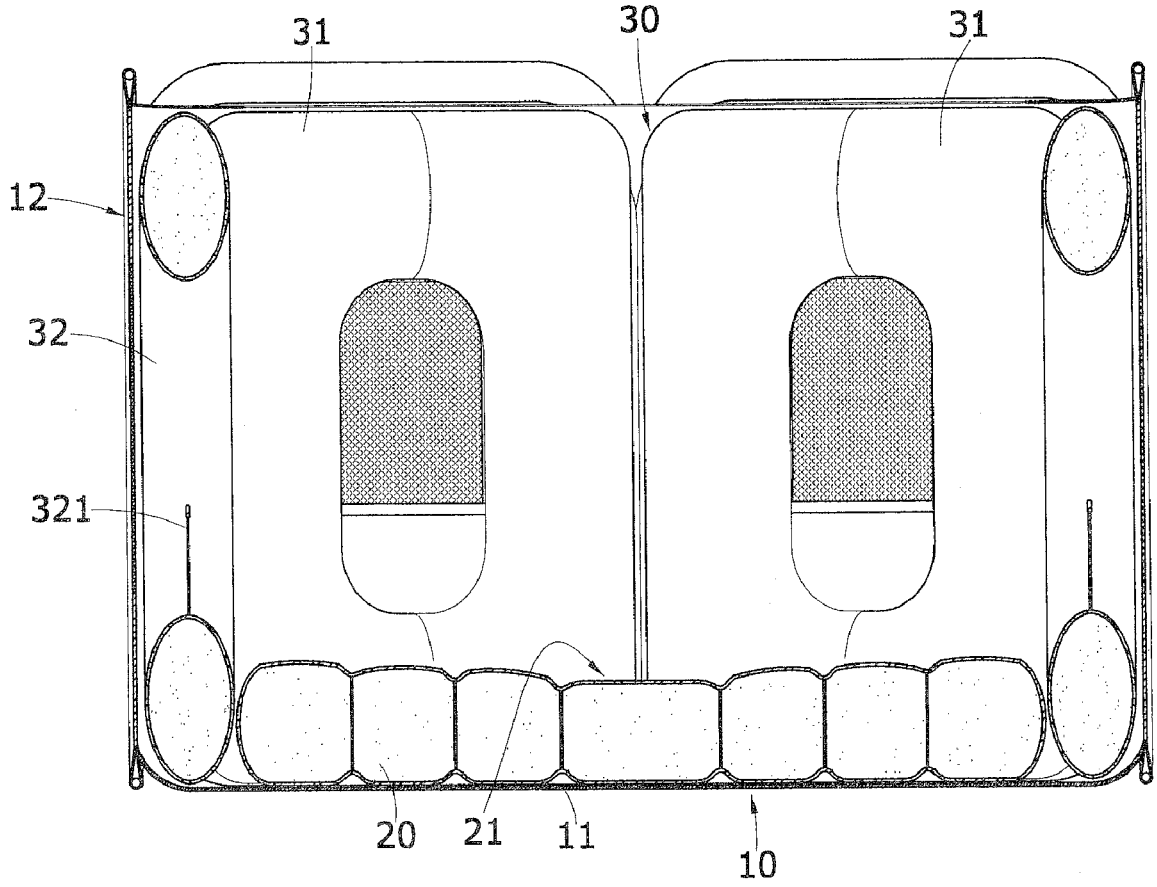
FIG. 3 is a longitudinal cross-sectional view of the combined structure of the present invention.

Referring to FIGS. 1, 2, and 3, the present invention at least includes a fence frame (10), an inflatable pad (20) and an inflatable wall (30).

The fence frame (10) is an enclosure formed by a bottom layer (11) and partition screens (12) for enclosing a circumference. The partition screens (12) are formed by a plurality of sheet bodies to obtain a higher strength, and to make the shape of the fence frame (10) a polygon, for example, a hexagon, an octagon or a polygon close to a circle. The partition screens (12) are formed by support strips (122) at the edge and a screen cloth surface (120) at the inner edge. The support strips (122) are preferably strong elastic thin steel wires. Meshed windows (121) may be arranged in the screen cloth surface (120) to improve the air convection.

The inflatable pad (20) has a suitable thickness, and has a shape the same as that of the bottom layer (11) of the fence frame (10). The inflatable pad (20) is disposed above the bottom layer (11). A concave arc groove face (21) is disposed downwardly on the inflatable pad (20).

The inflatable wall (30) has a plurality of units (31). Window holes (32) may be arranged in the units (31) alternately or in all of the units (31). The inflatable wall (30) is placed at the inner edge of the partition screens (12) of the fence frame (10). The lower part of the inflatable wall (30) bears against the inflatable pad (20). The window holes (32) then are aligned with the meshed windows (121) in the screen cloth surface (120). A curtain 321 may be disposed at about one third in the lower part of each of the window holes (32) for reducing the possibility that the toys (for example, small balls) are thrown out. Even when the balls bounce out of the window holes (32), they can be very conveniently taken back from the gap between the inflatable wall (30) and the partition screens (12).

The inflatable pad (20) and the inflatable wall (30) are formed by enclosing an enclosure plastic film that can be inflated with air and expands.

Figure 5:
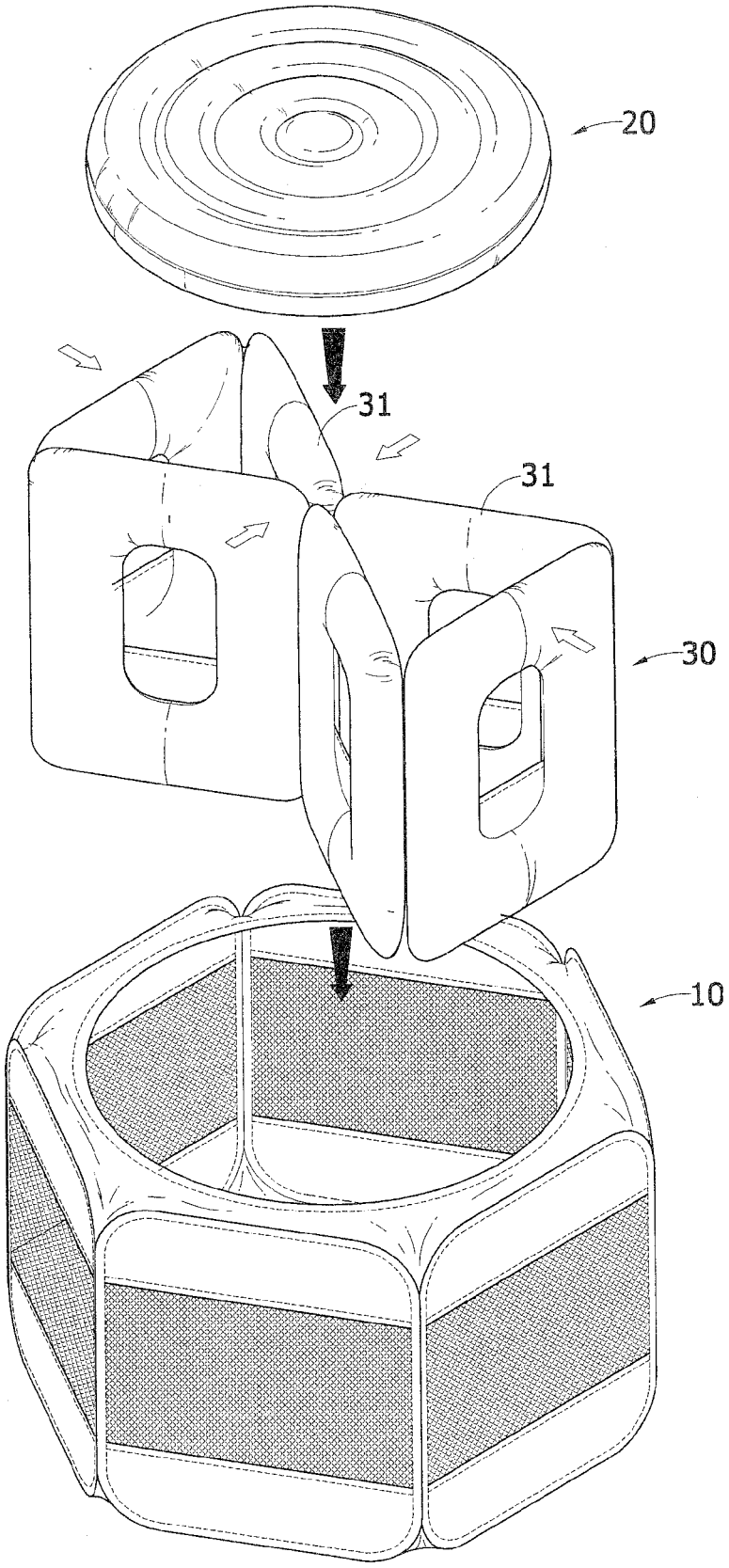
FIG. 5 is an action diagram of the combining sequence of the present invention.

Referring to FIG. 5, when the ball pool structure is combined, the units (31) of the inflatable wall (30) are slightly folded, and then are placed into the center of the fence frame (10). Once the force is released, the units (31) of the inflatable wall (30) are supported at the inner edge of the fence frame (10). Then, the inflatable pad (20) is placed at the center of the inflatable wall (30) inside the fence frame (10). Thus, the state for use is then ready, as shown in FIGS. 2 and 3. On the contrary, to dismantle the ball pool structure, the inflatable pad (20) and the inflatable wall (30) are deflated, and then they can be folded for storage (not shown). At the same time, after the partition screens (12) of the fence frame (10) are folded for storage, the volume becomes very small, which is easy to pack up and occupies little space.

Figure 4:
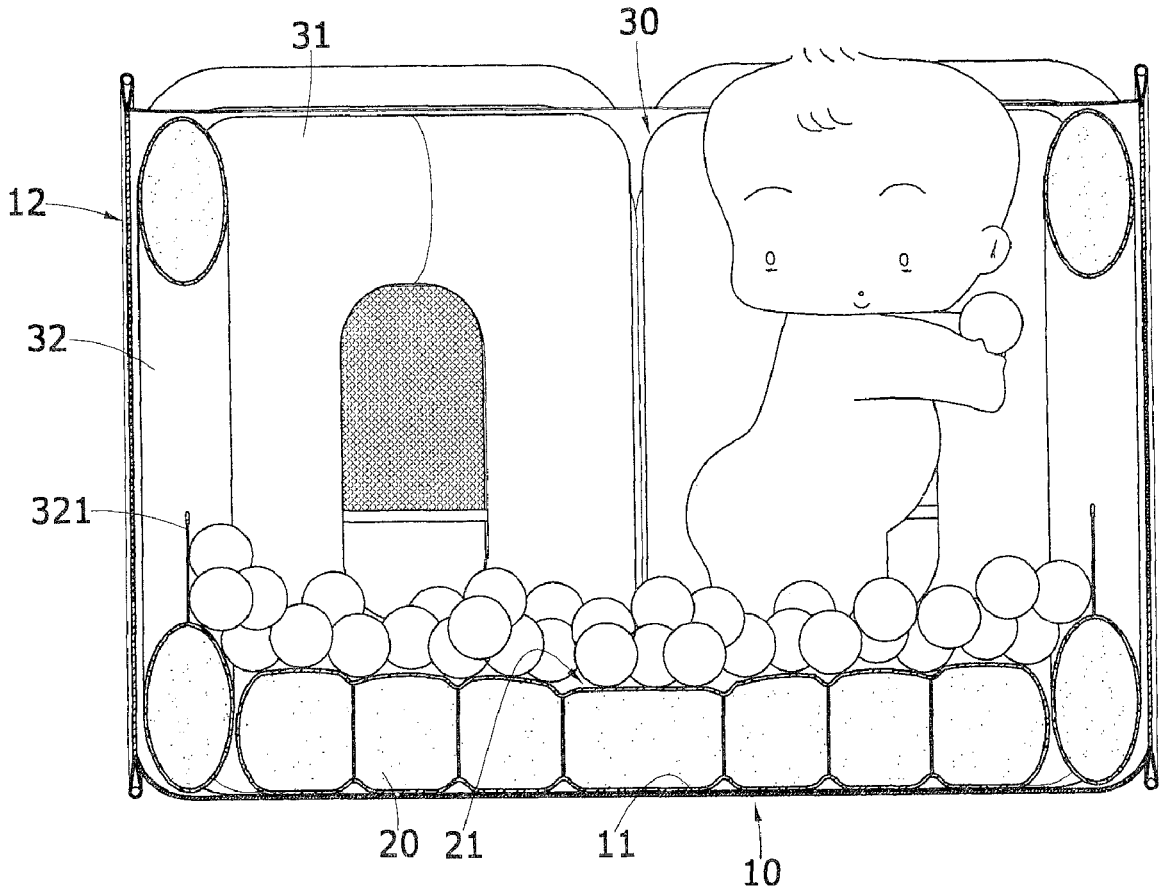
FIG. 4 is a schematic view of an embodiment of the present invention.

Referring to FIGS. 1, 2 and 4, during the use, the child is put into the safe space formed by the inflatable pad (20) and the inflatable wall (30). Moreover, the window holes (32) between the concave arc groove face (21) of the inflatable pad (20) and the inflatable wall (30) are designed, so the space is three-dimensional, which improves the entertainment effect of the present invention.

The whole architecture becomes more stable and not prone to fall down because the ball pool structure is tightly covered by the fence frame (10). The child can thus play more safely inside, which is also an important advantage of the design of the present invention.

Only a preferred embodiment of the present invention is described above, which is not intended to limit the scope of the present invention. The fence frame in a polygon shape with a different number of sides or a slightly changed shape shall still fall within the scope of the present invention. Therefore, equivalent variations and modifications made by those skilled in the art without departing the spirit and scope of the present invention shall all be covered in the scope of the present invention.

In conclusion, the present invention is safe, and is convenient to use and manufacture. Therefore, the ball pool structure meets the inventiveness requirements for a patent, and has the industrial applicability. Thus, according to the Patent Law, the applicant has filed a utility patent application to the Intellectual Property Office.

What is claimed is:

1. A family combined ball pool structure, comprising:

a fence frame, wherein the fence frame is an enclosure formed by a bottom layer and partition screens for enclosing a circumference, the partition screens are formed by a plurality of sheet bodies, a shape of the fence frame is enclosed as a polygon, and the partition screens are formed by support strips at an edge and a screen cloth surface at an inner edge, and meshed windows are arranged in the screen cloth surface;

an inflatable pad, having a same shape as that of the bottom layer of the fence frame, and disposed above the bottom layer, wherein a concave arc groove face is disposed downwardly on the inflatable pad; and an inflatable wall, having a plurality of units, wherein window holes are at least alternately arranged in the units, and half-covered curtains are disposed at lower parts of the window holes, the inflatable wall is placed at an inner edge of the partition screens of the fence frame, and a lower part of the inflatable wall bears against the inflatable pad;

wherein the inflatable pad and inflatable wall are formed by enclosing an enclosure plastic film that expands after being inflated with air inside.

2. The family combined ball pool structure according to claim 1, wherein the support strips at the edge of the partition screens are strong elastic thin steel wires.

3. The family combined ball pool structure according to claim 1, wherein the window holes in the inflatable wall are aligned with the meshed windows in the screen cloth surface.

4. The family combined ball pool structure according to claim 1, wherein the fence frame is a hexagon.

* * * * *